US005154457A

United States Patent [19]

Watanabe

[11] Patent Number: 5,154,457

[45] Date of Patent: Oct. 13, 1992

[54] VEHICULAR DOOR LOCK DEVICE

[75] Inventor: Hirofumi Watanabe, Yamanashi, Japan

[73] Assignee: Mitsui Kinzoku Kogyo Kabushiki Kaisha, Tokyo, Japan

[21] Appl. No.: 779,724

[22] Filed: Oct. 23, 1991

[30] Foreign Application Priority Data

Oct. 23, 1990 [JP] Japan ..... 2-285540

[51] Int. Cl.[5] ..... E05C 3/26

[52] U.S. Cl. ..... 292/216; 292/DIG. 62; 292/DIG. 23; 292/201

[58] Field of Search ..... 292/DIG. 23, DIG. 62, 292/216, 201, 336.3

[56] References Cited

U.S. PATENT DOCUMENTS

| | | | |
|---|---|---|---|
| 4,196,925 | 4/1980 | Torii | 292/DIG. 23 |
| 4,756,563 | 7/1988 | Garwood et al. . | |
| 4,775,176 | 10/1988 | Ikeda | 292/216 |
| 4,904,006 | 2/1990 | Hayakawa et al. | 292/216 |
| 5,046,341 | 9/1991 | Ogino et al. | 70/264 |

FOREIGN PATENT DOCUMENTS

| | | | |
|---|---|---|---|
| 2503281 | 8/1975 | Fed. Rep. of Germany | 292/DIG. 23 |

*Primary Examiner*—Eric K. Nicholson

*Attorney, Agent, or Firm*—Browdy and Neimark

[57] ABSTRACT

A vehicular door lock device having a latch and ratchet mechanism comprises a sill knock lever connected to a lock button on a door interior so as to change its position between the locked one and the unlocked one, a key lock lever connected to a key cylinder of the door and to the sill knob lock lever through lost-motion, an actuator changing the position of the sill knob lock lever to its unlocked one and the locked one, an opening lever connected to the door opening handle, and an operating rod connected to the sill knob lock lever and the opening lever. A body of the lock device has a swelled portion formed on its rear side in order to define a guide groove a striker fixed to the car body proceeds therethrough. The key lock lever is rotatably installed in a room exterior side of a central line of the body and the sill knob lock lever is placed at a side of the key lock lever and at a room interior of the central line of the body. These key lock lever and sill knob lock lever are fixed to an output shaft of the actuator.

3 Claims, 6 Drawing Sheets

VEHICULAR DOOR LOCK DEVICE

BACKGROUND OF THE INVENTION

The conventional vehicular door lock device has a lock lever connected to a key cylinder and an inner lock button (sill knob) so as to exchange the condition of the lock device from its locked one to its unlocked one. Ordinarily the lock lever can be changed by operations of the key cylinder or sill knob of a car owner. Somebody, for example, thieves can change or move the lock lever of the vehicular door lock device. In order to prevent the lock lever from being wrongly changed from the outside, various devices are employed to the conventional door lock device.

It is apparent that when the construction of the lock device provided with one lock lever connecting a key cylinder and a sill knob is improved to raise its crime preventability, the size of the lock device inevitably becomes larger.

U.S. Pat. No. 4,756,563 discloses a lock device provided with a lock lever having a key lock lever connected to a key cylinder and a sill knob lock lever connected to the sill knob. According to the conventional lock device disclosed in the U.S. Pat. No. 4,756,563, which employing two lock levers, it is possible to connect the key cylinder and the key lock lever through a rod or the like without any lost-motion. However, when the key cylinder and the key lock lever are connected without any lost-motion, the key lock lever becomes impossible the crime preventability very much. As described above, the conventional lock device having two lock levers has disadvantageously a number of constructional parts, but the size of the lock device relatively is small and its crime preventability is high.

However, the lock device disclosed in U.S. Pat. No. 4,756,563 has a shortcoming in that the key lock lever and the sill knob lock lever are rotatably journalled with a body of the lock device through a single shaft. That is, as shown in FIG. 13, in general, the inner side B of the body A of the conventional lock device has a high crime preventability and the outer side has a low preventability. A guide member for the door glass pane is placed at a central portion of the car body A and the guide member is a block for preventing unfair operation of the lock device from the outside, raising a crime preventability or safety of the interior side B.

Consequently, it is reasonable that the key lock lever is placed at the exterior side C of the vehicular room of low crime preventability and the sill knob lock lever is at the interior side B of high crime preventability, and these lock levers are journalled with different shafts, making the lock device of a high crime preventability or safe and of thin.

SUMMARY OF THE INVENTION

Consequently, it is the object of the present invention to provide a thin lock device having a high crime preventability due to provision of two lock levers, respectively installed on the interior side of the vehicular room of a high crime preventability, and the exterior side of a low crime preventability.

It is another object of the present invention to provide a high crime preventable small-size lock device with an actuator for electrically changing the lock condition of the lock device, and an output shaft of the actuator has a sill knob lock lever fixed thereto.

EMBODIMENT

Figure 1:
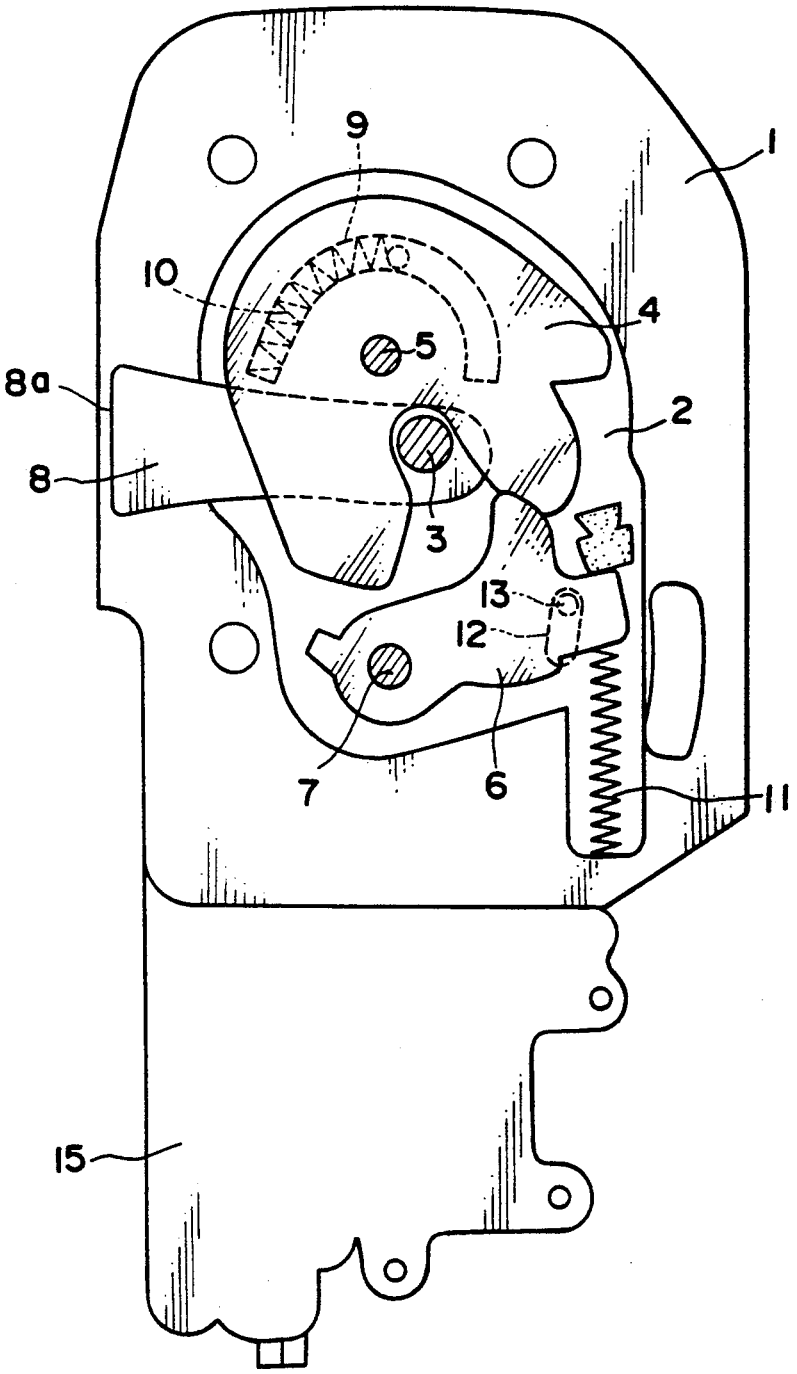
FIG 1 is a plan view of a body of the vehicular door lock device according to the present invention.

An embodiment of the vehicular door lock device according to the present invention will be explained with reference to the accompanying drawings.

The plastics made body 1 of the lock device has a concave portion 2 formed thereon. Within the concave portion 2, a latch 4 engaged with a striker 3 fixed to the car chassis is rotatably journalled through a shaft 5, and a ratchet 6 engaged with the latch 4 so as to prevent the latch 4 from reverse-rotating is rotatably journalled through a shaft 7. The striker 3 proceeds through a passage 8 of the body 1. The latch 4 is urged clockwise by a spring 10 placed or installed in an arcuate groove 9 of the body 1. A spring 11 always presses the ratchet 6 to the latch 4. The ratchet 6 has a protrusion 13 extending through an arcuate opening 12 formed on the body 1 and projecting from a rear face of the body 1.

Figure 12:
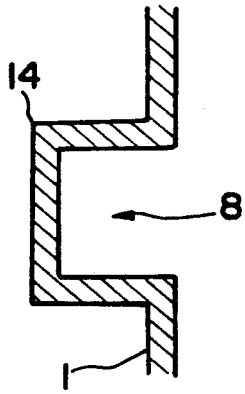
FIG 12 is a section taken along Z—Z line shown in FIG 3.

A channel or swelled portion 14 extending left and right is integrally formed on a rear side of the body 1. The swelled portion 14 has a U-shaped cross section shown in FIG 12. An inner side of the swelled portion 14 is used as the passage 8. An actuator portion 15 for electrically changing a locked condition of the lock device is attached to a lower portion of the body 1. The output shaft 16 of the actuator portion at the central or interior side B of the body 1 of the lock device. There is an entrance 8*a* of the passage 8 on the interior side B. A sill knob lock lever 28 is fixed to the output shaft 16, which lock lever 28 being connected to the interior lock button or sill knob (not shown) through a rod, and etc.

The opening lever 17 connected to a door opening lever (not shown) is journalled to an upper portion of the body 1 through the shaft 18. An upper end of the operating rod 22 is journalled to one end portion 20 of the opening lever 17 through a shaft 21. The operating rod 22 has an oval opening 24 with which a pin 26 placed on a front end of a connecting lever 25 is engaged. One end 19 of the sill knob lock lever 28 is connected to a foundation of the connecting lever 25. As a result, when function of the output shaft 16 or sill knob rotates the sill knob lock lever 28 around the output shaft 16, the lower end 23 of the operating rod 22 moves to the unlocked position shown in FIG. 2 and the locked position in FIG. 3.

After the operating rod 22 is displaced to the locked position and unlocked position, it is noted that the rod 22 doesn't overlap with the swelled portion 14.

The release lever 30 placed so as to overlap with the connecting lever 25 is journalled with and connected to the body 1 through a shaft 31 placed on the same line as the shaft 7. A protrusion 13 protruding from the ratchet 6 is fixed to the release lever 30, resulting in an integral rotation of the release lever 30 and the ratchet 6.

There is a contacting portion 32 on the front end of the release lever 30, which portion 32 being adapted to contact with the lower end 23 of the operating rod 22 when it is under the unlocked condition and the operating rod 22 lowers. However, when it is under the locked condition, the contacting portion 32 doesn't contact with the lower end 23 of the operating rod 22.

Figure 13:
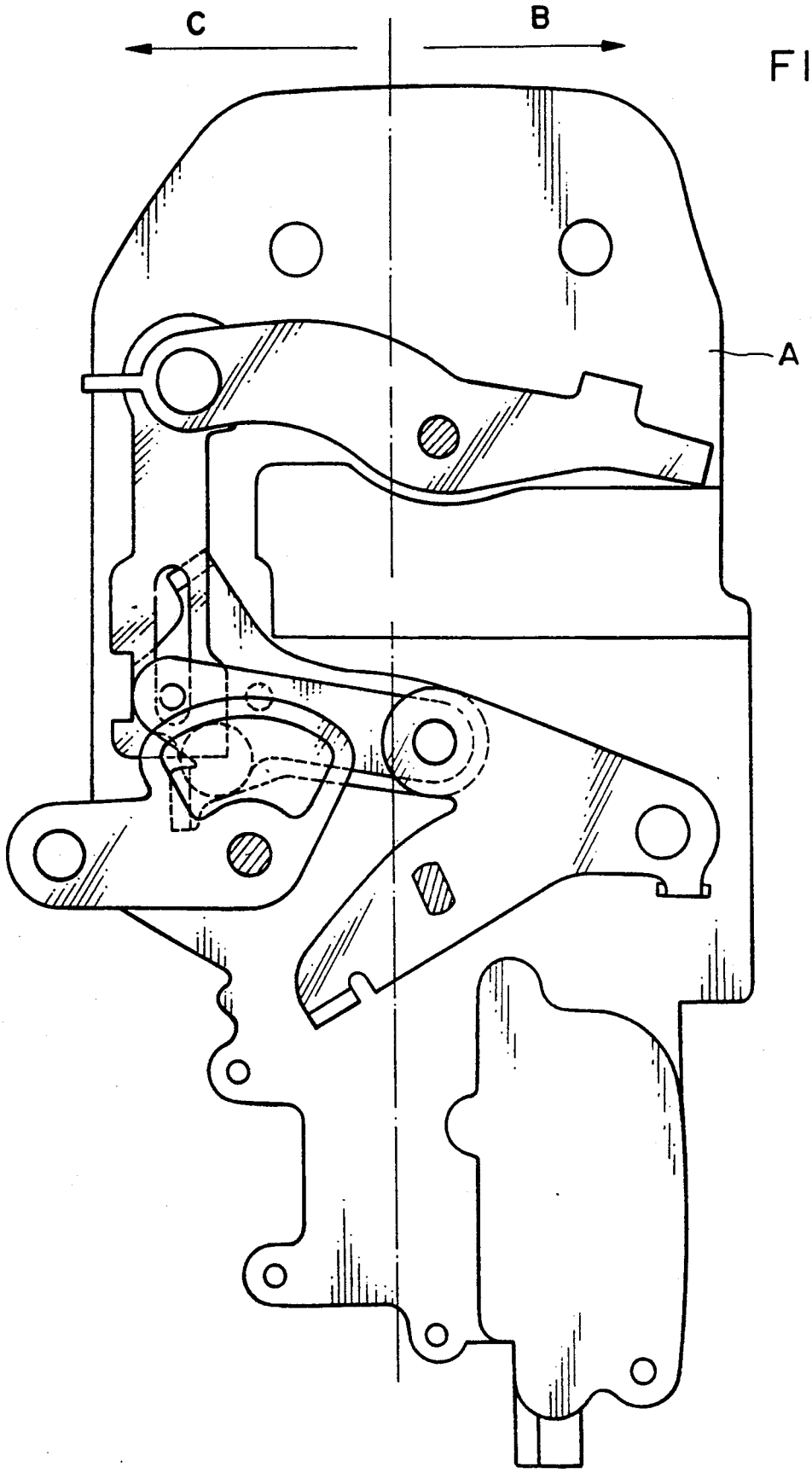
FIG 13 is an outline explanation view.

The key lock lever 34 connected to the key cylinder without any lost-motion is journalled with the body 1 through the shaft 33. The key lock lever 34 is placed at a side of the sill knob lock lever 28 and in the exterior side C of the body 1 as shown in FIG. 13. The rear face of the key lock lever 34 has an arched concave portion 35 formed thereon, with which concave portion a convex portion 36 formed on the connecting lever 25 is engaged. Accordingly, the key lock lever 34 and the sill knob lock lever 28 are connected through lost-motion.

An operation of the vehicular door lock device according to the present invention will be explained.

When closing the door, the striker 3 placed at the side of car body is engaged with the latch 4 so as to rotate counterclockwise as shown in FIG. 1 the latch against resilient force of the spring 10, being engaged claws of the ratchet 6 with the latch 4 in order to prevent reverse-rotation of the latch 4.

Figure 2:
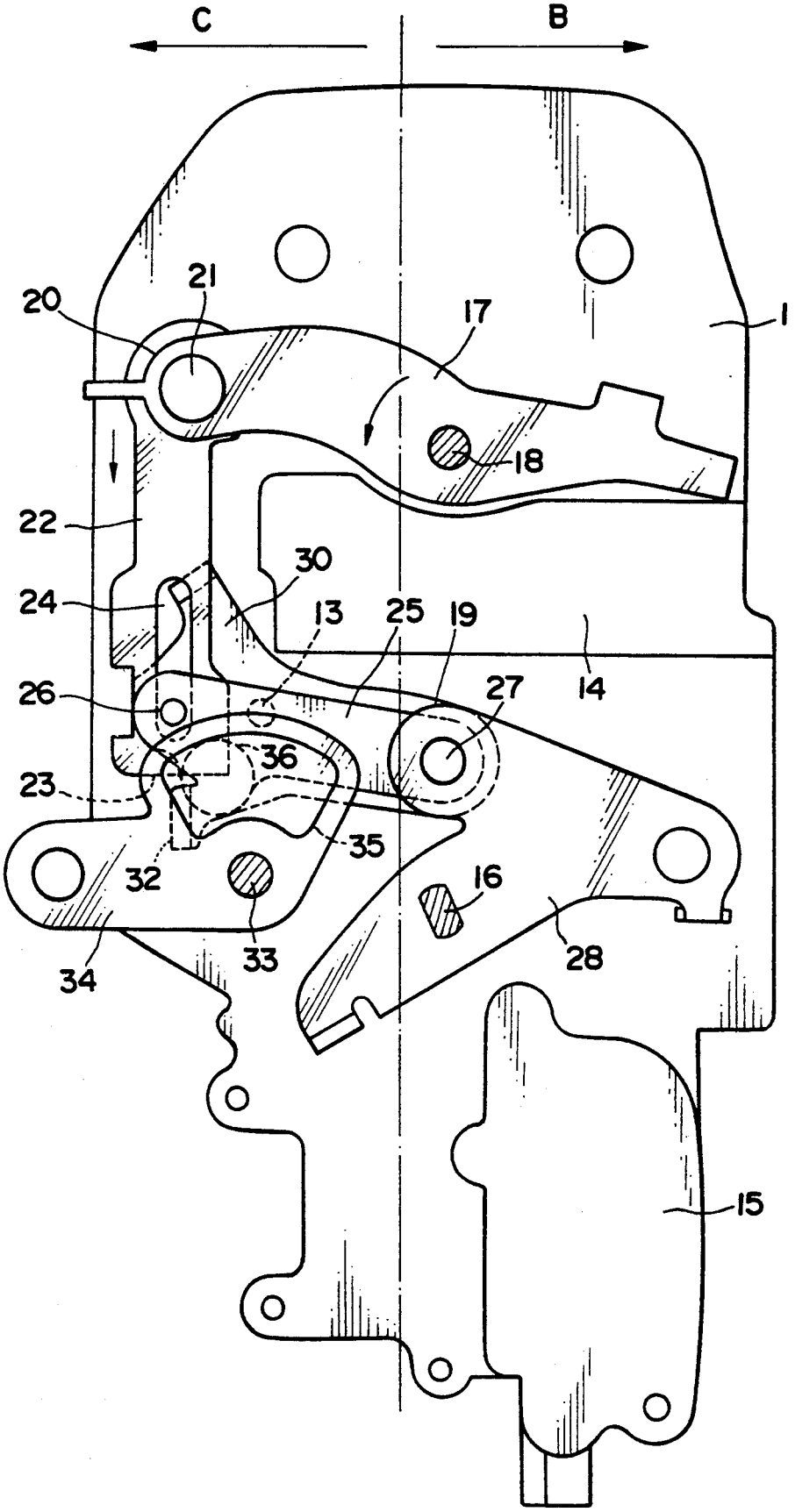
FIG 2 is a rear view of the lock device in its unlocked condition.

Meanwhile, as shown in FIG. 2, manipulating the lever for opening the door rotates counterclockwise the opening lever 17, the opening rod 22 lowers, the lower end 23 of the rod pushes down the contacting portion 32 of the release lever 30. Consequently, the release lever 30 rotates counterclockwise around the shaft 31, the ratchet 6 rotates through the protrusion 13 against resilient force of the spring 11 being displaced from the latch 4 and releasing an engagement of the latch 4 with the striker 3.

Figure 3:
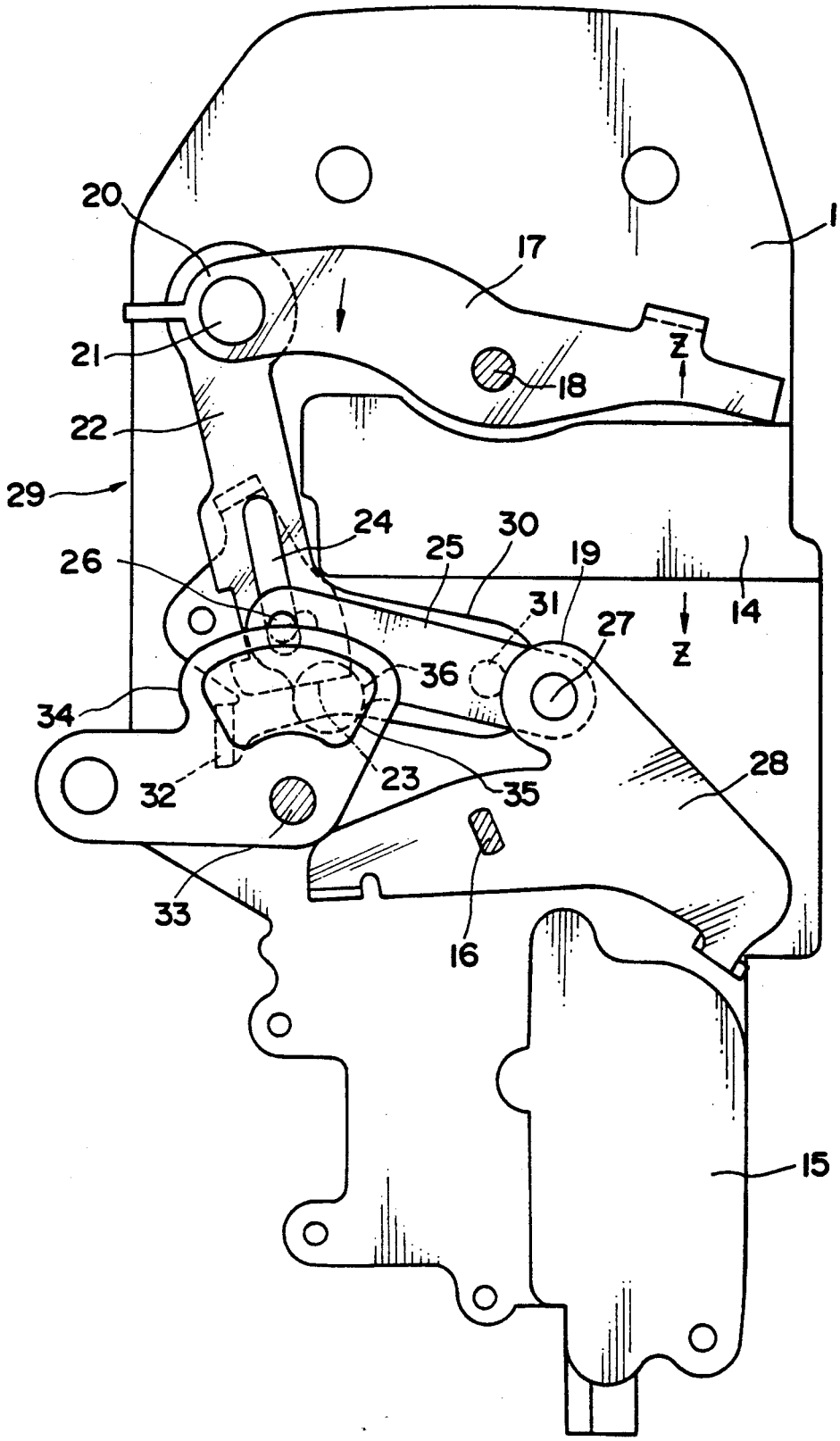
FIG 3 is a rear view of the lock device in its locked condition.
Figure 4:
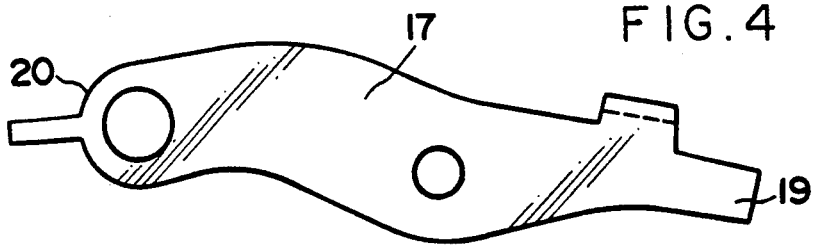
FIG 4 is a plan view of the opening lever.
Figure 5:
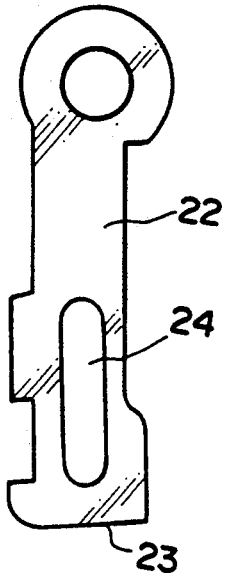
FIG 5 is a plan view of the operating rod.
Figure 6:
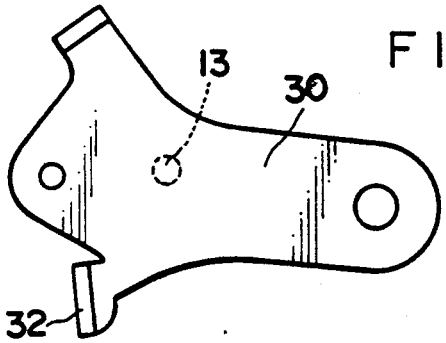
FIG 6 is a plan view of a release lever.
Figure 7:
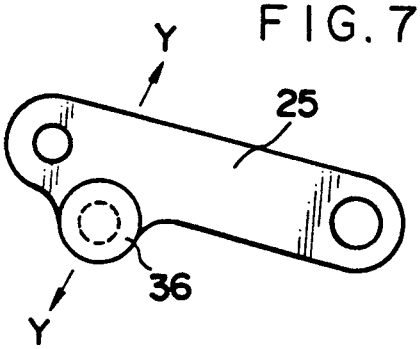
FIG 7 is a plan view of a connection lever.
Figure 9:
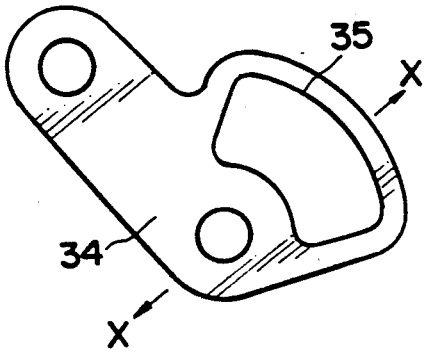
FIG 9 is a plan view of the key lock lever.
Figure 8:
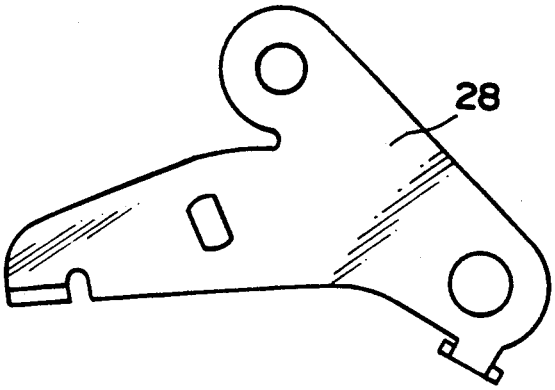
FIG 8 is a plan view of the sill knob lock lever.
Figure 10:
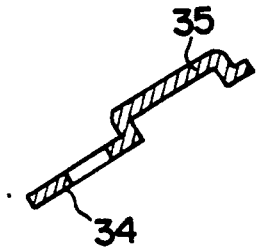
FIG 10 is a section taken along X—X line shown in FIG 9.
Figure 11:
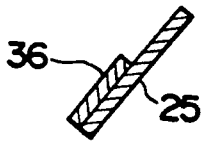
FIG 11 is a section taken along Y—Y line shown in FIG 7.

Next, operating sill knob rotates the sill knob lock lever 28 in a condition shown in FIG. 2 clockwise in FIG. 3, or energizing the actuator portion 15 rotates the output shaft 16 in order to rotate clockwise the sill knob lock lever 28 in a condition of FIG. 2, so that the connecting lever 25 connected to the end 19 of the sill knob lock lever 28 through the shaft 27 move to the right, the pin 26 of the connecting lever 25 is engaged with the oval opening 24 of the operating rod 22, resultantly the lower end 23 of the operating rod 22 moves to the right into its locked condition. Then, because the sill knob lock lever 28 and the key lock lever 34 are connected through lost-motion, only the sill knob lock lever 28 rotates as shown in FIG. 3.

If the door opening lever or handle is operated and the opening lever 17 rotates counterclockwise, the lower end 23 of the operating rod 22 doesn't contact with the contacting portion 32 resulting in no-opening of the door.

Meanwhile, under the condition of FIG. 2, the opening lever 17 is changed to its locked condition by a key operation, so that the key lock lever 34 connected to the key cylinder without lost-motion rotates clockwise, the concave portion 35 engages with the convex portion 36, and resultantly the sill knob lock lever 28 rotates clockwise being changed to the locked condition.

If a tool of a thief is inserted into the door structure in order to criminally release the lock device under its locked condition as shown in FIG. 3, the tool is prevented from accessing to the room interior B by means of a glass guide member installed at about the mid of the body 1. In other words, the thief cannot rotate the key lock lever 34 attached to the room exterior C, since the key lock lever 34 is connected to the key cylinder without lost-motion and the key lock lever is not able to rotate without a key operation.

In addition, the sill knob lock lever 28 and the key lock lever 34 are placed side by side and they are supported through different shafts, so it is possible to make a thickness of the lock device thin.

Still additionally, because the sill knob lock lever 28 rotates around the output shaft 16 of the actuator 15, it is possible to the present invention providing a reasonably-arranged small-size lock device with an actuator.

What is claimed is:

1. A door lock device having a latch and ratchet mechanism, said door lock device comprising:

a lock device body mounted between an interior side and an exterior side of a door;

a sill knob lock lever, alternatively operated to be locked or unlocked by a manual lock button or an electrically powered actuator;

a key lock lever engaged and operated without lost-motion by a key cylinder on said door;

said key lock lever connected with lost-motion to said sill knob lever;

an opening lever engaged and operated by a door opening lever to disengage said latch from said ratchet when said sill knob lever is unlocked;

said key lock lever rotatably mounted on a first shaft on said lock device body between the longitudinal axis of said lock device body and said exterior side of said door;

said sill knob lock lever connected to an output shaft of said electrically powered actuator;

said sill knob lock lever located at a side of and coplanar with said key lock lever and rotatably mounted on a second shaft on said lock device body between the longitudinal axis of said lock device body and said interior side of said door.

2. The door lock device according to claim 1, further comprising:

a channel formed on a rear face of said lock device body to allow entry of a striker on a car body;

said opening lever located above said channel;

said key lock lever and said sill knob lock lever located below said channel;

an operating rod spaced from said channel and connected to said sill knob lock lever and said opening lever;

said operating rod disengaging said latch from said ratchet key opening said door opening lever when said sill knob lever is unlocked.

3. The door device according to claim 2, wherein said operating rod and said sill knob lever are connected by a connecting rod extending transversely.

* * * * *